US006312141B1

(12) United States Patent
Liu

(10) Patent No.: US 6,312,141 B1
(45) Date of Patent: Nov. 6, 2001

(54) SIMULATED FIREWORKS LAMP ASSEMBLY

(76) Inventor: Limin Liu, Rm 421 Building 63 Beiwencui Road, Donling District, Shenyang City of Liaoning (CN)

( * ) Notice: Subject to any disclaimer, the term of this patent is extended or adjusted under 35 U.S.C. 154(b) by 0 days.

(21) Appl. No.: 09/413,413

(22) Filed: Oct. 6, 1999

(30) Foreign Application Priority Data

Oct. 7, 1998 (CN) ..... 98239009 U
Sep. 6, 1999 (CN) ..... 99118779 A

(51) Int. Cl.[7] ..... F21S 13/14

(52) U.S. Cl. ..... 362/252; 362/554; 362/565; 40/444; 40/442; 40/547; 40/581

(58) Field of Search ..... 362/551, 554, 362/567, 568, 565, 236, 227, 252, 806, 811, 807; 40/427, 428, 431, 442, 444, 540, 541, 546, 547, 550, 553, 581

(56) References Cited

U.S. PATENT DOCUMENTS 2,016,794 * 10/1935 Bade et al. ..... 362/567
2,557,383 * 6/1951 Kerwer ..... 40/214
3,723,723 * 3/1973 Lerner ..... 362/251
4,179,832 * 12/1979 Lemelson ..... 40/540
4,782,336 * 11/1988 Bailey ..... 340/752
5,558,421 * 9/1996 Guastella ..... 362/565
5,865,533 * 2/1999 Liu ..... 362/583

FOREIGN PATENT DOCUMENTS

85200877 U 4/1986 (CN) .
2310602 Y 12/1998 (CN) .

* cited by examiner

*Primary Examiner*—Sandra O'Shea
*Assistant Examiner*—Ismael Negron
(74) *Attorney, Agent, or Firm*—Calfee, Halter & Griswold

(57) ABSTRACT

The lamp assembly includes an emitting framework, a supporting ball, radiating levers and electronic-controller. The emitting framework is connected to the radiating levers via the supporting ball; the radiating levers to which explosion lamps and flashing lamps attach are bent into such a shape as to produce the effect of fireworks exploding; the electronic-controller is connected with firing lamps, explosive lamps and flashing lamp. The specially manufactured lamp assembly can effectively simulate the explosion process of fireworks controlled by electronic-control system.

22 Claims, 4 Drawing Sheets

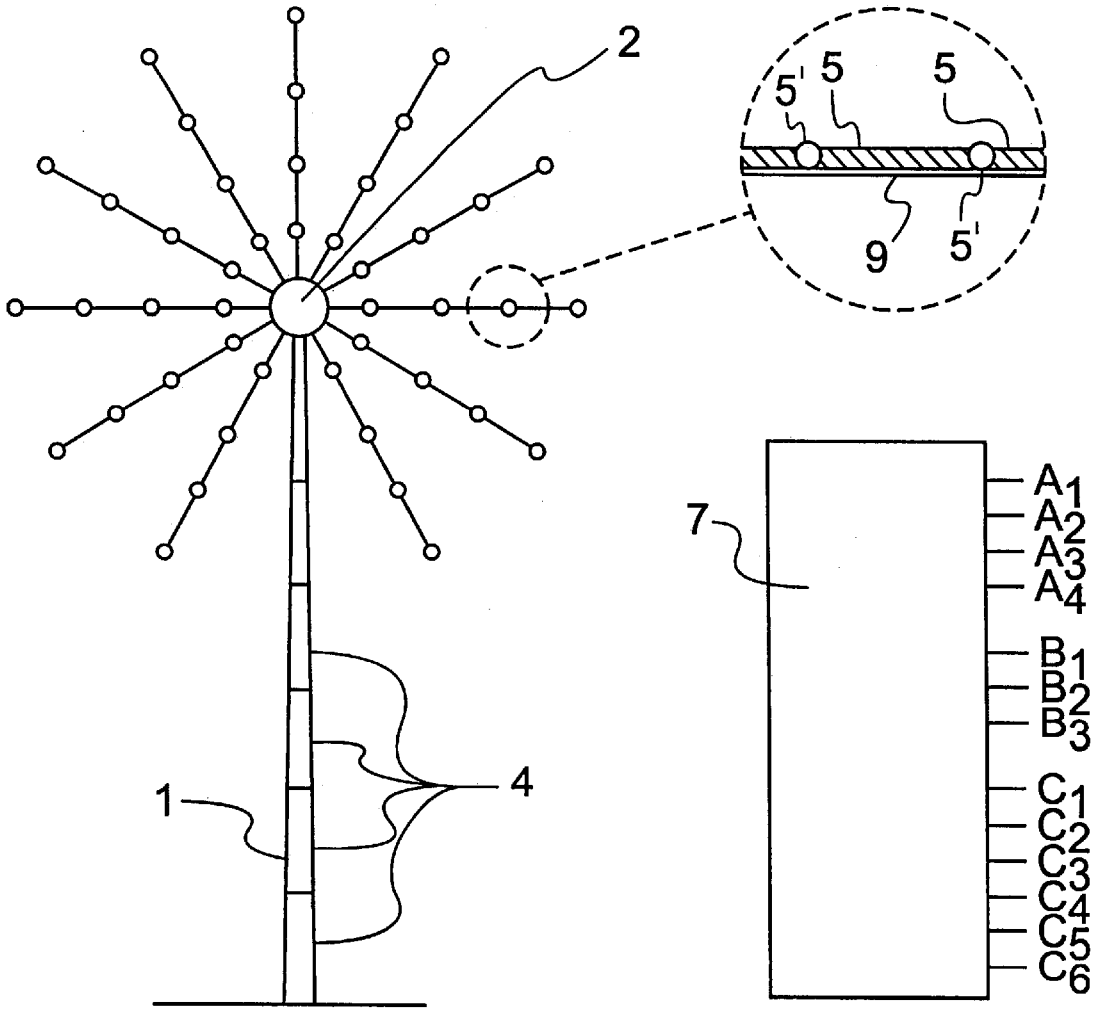
FIG. 3
FIG. 5
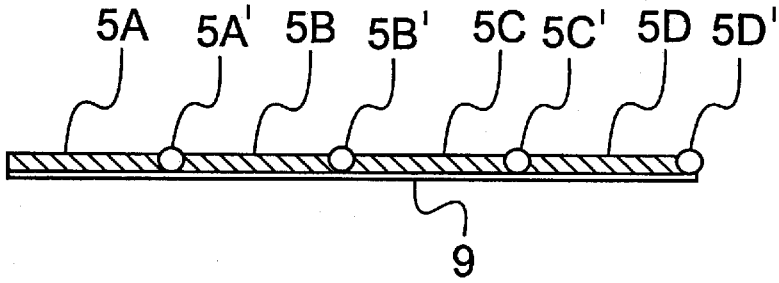
FIG. 4

SIMULATED FIREWORKS LAMP ASSEMBLY

This application claims the benefit under 35 U.S.C. §119 of Chinese application number 99118779.2 filed on Jun. 9, 1999 and Chinese application number 98239009.2 filed on Jul. 10, 1998. The present invention relates to a lamp assembly. In particular the present invention relates to a lamp assembly which can simulate the explosion process of fireworks and the manufacturing method thereof.

BACKGROUND OF THE INVENTION

Conventional fireworks are a cardboard cylinder filled with powder and oxidizer, which flies up to the air and produces flames of various colors after being fired, making festival atmosphere more warm. However, it has several drawbacks, including high production cost, causing environment pollution, possibility of injuring people and even causing fire disaster and the possibility of exploding and burning during its production and transport. Therefore, setting off fireworks is prohibited in many cities, and so the festival warm atmosphere is reduced dramatically.

It is desired that there is a product, which can produce the same effect as conventional fireworks but does not have the above drawbacks.

SUMMARY OF THE INVENTION

The object of the present invention is achieved by an electronic-controlled fireworks lamp assembly, including an emitting framework, a supporting ball, radiating levers and a controller. The emitting framework is connected to radiating levers via supporting ball, the radiating levers are bent into a shape as to produce the effect of fireworks explosion. The explosion lamp and flashing lamp are attached to the radiating levers. The controller is connected with firing lamps, explosion lamps and flashing lamps. Alternatively, the radiating levers can be straight levers to which explosion lamp and firing lamp attach. The emitting framework is consisted of metal tubes or metal supports to which firing lamps attach. The supporting ball is a metal support of spherical shape having a plurality of installing bores therein. Explosion lamps are arranged on at least three spherical layers radially outward from the center of the supporting ball by inserting them into the bores of the supporting ball directly.

The object of the present invention is achieved by an electronic-controlled fireworks lamp assembly, including an emitting framework, a supporting ball, radiating levers and a controller. The emitting framework is connected to radiating levers via supporting ball, the radiating levers are bent into such a shape as to produce the effect of fireworks explosion. The explosion lamp and flashing lamp are attached to the radiating levers. The controller is connected with firing lamps, explosion lamps and flashing lamps. Alternatively, the radiating levers can be straight levers to which explosion lamp and flashing lamp attach. The emitting framework is consisted of metal tubes or metal supports to which firing lamps attach. The supporting ball is a metal support of spherical shape having a plurality of installing bores therein. Explosion lamps are arranged on at least three spherical layers radically outward from the center of the ball. The radiating levers are connected to the supporting ball by inserting them into the bores of the supporting ball directly.

The manufacturing method of the electronic-controlled fireworks lamp assembly is as follows: Firing lamp is composed of colored tubes made of rigid plastics with high strength; the interior of the tubes is provided with rows of light-emitting bodies and lead the extension line out; the ends of the tubes are sealed tightly with adhesive; these tubes can constitute emitting framework itself, or can be used in combination with radiating levers, The emitting framework can be designed into the shape of the block, lever or artistic model, it can flash upward or do not flash; and the framework can be colored lamp or colored cylinder in which electrical wires and controller are provided; the supporting ball is an explosion center in which bores are provided for radiating levers passing through; the supporting ball can be provided at a plurality of locations on the emitting framework or radiating levers, producing many explosion centers, and the controller in the emitting framework can control these centers and make them explode and radiate successively. The shape of radiating levers can be curved, straight and overlapping and the levers have different length that can be combined into many geometry such as spherical shape and fan shape. The cross-section of the radiating levers can be circular, flat or special shaped. Explosion points explode outward successively taking the supporting ball as explosion center and supporting balls can be arranged on upper, middle and lower part of the lamp assembly as well as on radiating levers and be used for the second and third radiation. The firing lamp is made of rigid polycarbonate, the inner surface of which is provided with refractive stripes. The explosion order of the lamp assembly is that the firing lamps on the emitting framework are lit up from lower to upper as far as reaching the center of the supporting ball and then radiation lamps are lit up outward from the center of supporting ball and after that the flashing lamps flash. Explosions operate in layers during the whole process and flashing lamps flash finally, thus an explosion cycle is completed.

The present invention basically replaces conventional fireworks of powder type by specially manufactured fireworks lamp assembly which simulates the explosion process of conventional fireworks using electronics-control system. The present invention is easy to use and operate safely, which can replace conventional fireworks very effectively and can be used in the cities and countryside for decoration in cases of festivals and important celebration activities.

BRIEF DESCRIPTION OF THE FIGURES

FIG. 3 is a schematic view of the structure according to the second embodiment of the present invention;

FIG. 4 is a schematic view of the structure of a radiating lever according to the second embodiment of the present invention;

FIG. 5 is a schematic view of the integrated chip according to the present invention;

DETAILED DESCRIPTION OF THE INVENTION

The present invention will be described in more detail by referring to the embodiments.

First Embodiment

Figure 1:
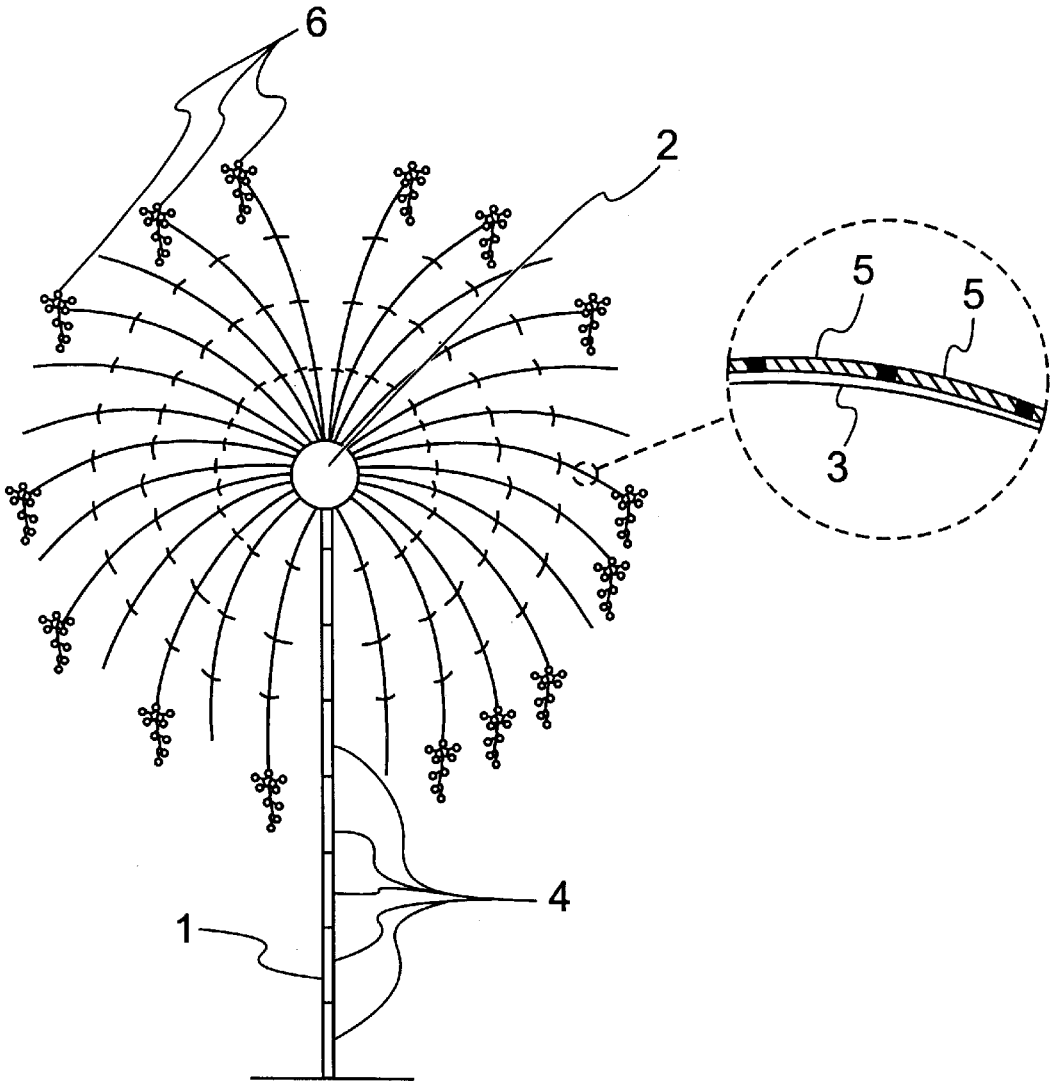
FIG. 1 is a schematic view of the structure according to the first embodiment of the present invention.
Figure 2:
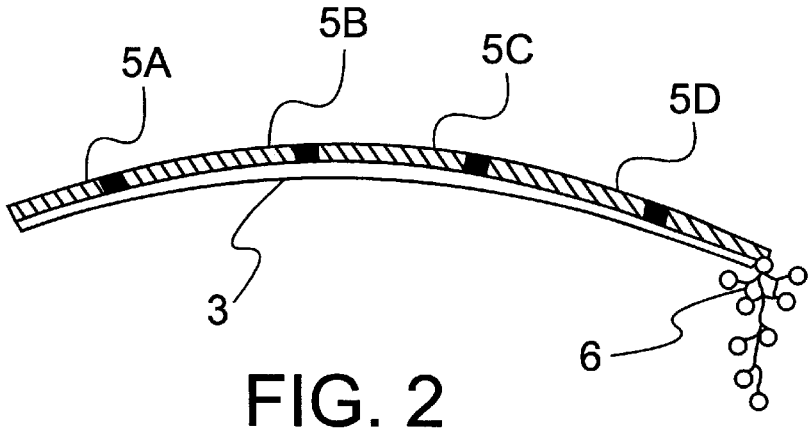
FIG. 2 is a schematic view of the structure of a radiating lever according to the first embodiment of the present invention.

The present invention provides an electronic-controlled simulated fireworks assembly which includes an emitting framework 1, a supporting ball 2, radiating levers 3 and 9, and an electronic-controller 7. As shown in FIG. 1, the radiating levers 3 may be arcuate shaped. The emitting framework 1 comprises metal tubes or metal supports to which firing lamps attach, and can be a colored lamp or colored cylinder in which electrical wires and controller are provided. A supporting ball 2 is connected to the emitting framework 1. The supporting ball 2 is a metal support of spherical shape having a plurality of installing bores therein. The supporting ball 2 may be provided at a plurality of locations on the emitting framework 1 or the radiating levers to produce the effect of explosion at a plurality of locations. The electronic-controller can control these explosion locations in the emitting framework and make them explode and radiate successively. The arcuate radiating levers 3 are bent to form the shape of the tracks of firework explosion along its length and inserted into respective bores of the supporting ball 2. Alternatively, the radiating levers 9 can be straight, as shown in FIG. 3. Furthermore, the radiating levers 3, 9 can overlap or have different lengths in order to achieve many different geometrical shapes such as a spherical shape or a fan shape. The cross-section of the radiating levers 3, 9 can be circular, flat, or special-shaped. Then bulbs or tubular lamps having different colors are attached to respective radiating levers and divided into two kinds of lamps. One is explosion lamp 5 and the other is flashing lamp 6 and they are arranged in regular order. These bulbs or tubular lamps can be arranged to have various special configurations and be provided on different spherical layers. These spheres take the supporting ball as their center. The number of the layers of the explosion lamps 5 should be no less than three. The more the layers are and the shorter the distance between the layers is, the better the continuity of explosion of these lamps is and the more effective the simulation of the conventional fireworks is. The lamps in the same sphere (layer) are connected together, so that lamps in different layers are lit up successively outward from the ball center. The flashing lamps 6 are on the outer ends of the radiation levers 3 and are consisted of a plurality of small bulbs and stroboscopic bulbs. These flashing lamps 6 are divided into two or more lines and controlled by electronic-controller 7 such that they are lit up alternately or simultaneously. The firing lamps 4 are arranged in sections on the emitting framework 1 and controlled by the controller such that they are lit up successively from lower to upper part of the emitting framework and produce the effect of moving upward. The firing lamps may comprise colored tubes made of rigid plastics with high strength; the interior of the tubes is provided with rows of light emitting bodies and lead the extension line out; the ends of the tubes are sealed tightly with adhesive. These tubes can constitute the emitting framework or can be used in combination with the radiating levers. Preferably, the firing lamp is made of rigid polycarbonate, the inner surface of which is provided with refractive strips. The lighting of the emitting framework 1 with lamps completes the assembly. The electronic-controller 7 is connected respectively with the firing lamps 4, explosion lamps 5 and flashing lamps 6. Firstly the firing lamps 4 are lit up in order from lower to upper, then the explosion lamps 5 are lit up in order of A B C A+B A+B+C B+C C meanwhile the firing lamps 4 are put off, and then the flashing lamps 6 are lit up meanwhile the explosion lamps 5 are put off, finally the firing lamps 4 are lit up again after the flashing lamps 6 are put off and then the above cycle is repeated again.

Second Embodiment

Figure 6:
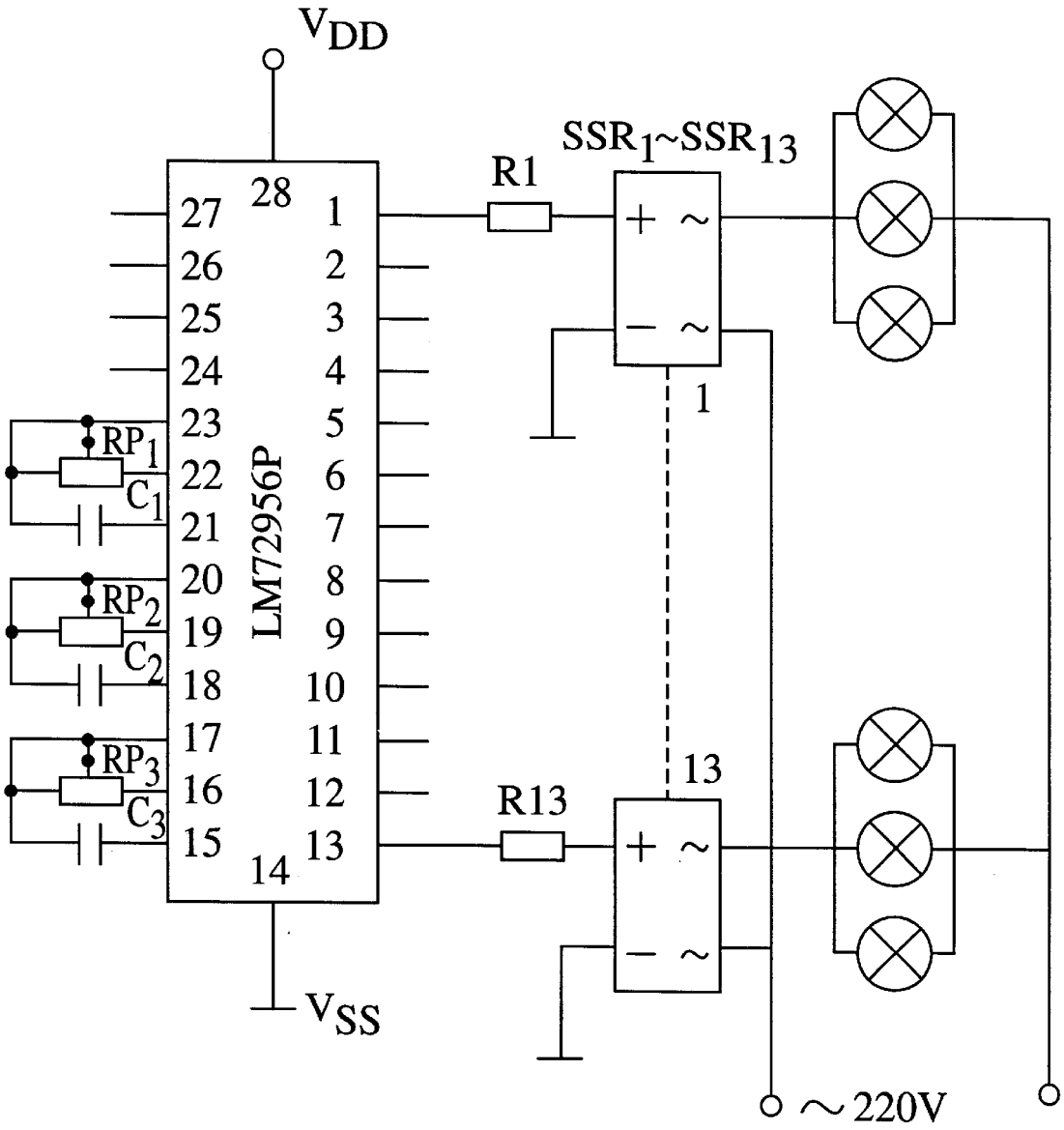
FIG. 6 is a electrical circuit diagram according to the first embodiment of the present invention.

In present embodiment, the radiating levers 3 are straight levers on which are arranged the explosion lamps 5 which are lit up in the order of A+A' B+B' C+C' A+A' A+B+B' A+B+C+C' B+C+C' C+C' C'. The firing lamps 4, explosion lamps 5 and flashing lamps 6 can be consisted of neon lamps, bulb, bulb series, molded tubular lamps and stroboscopic bulbs. The controller is based on specially designed integrated circuit (IC) LM7295BP which is a plastics-capsulated dual in-line package and is made by using bi-polar and COMS compatible technology and is operated at 3–18V and can output current large enough to activate solid relays directly. The FIG. 6 shows the arrangement of LM7259BP's pins, in which pins 24–27 are programming pins which can lock the output program by connecting with high and low electrical potentials. LM7259BP has 13 output pins which are divided into 3 groups and by reference to the first embodiment it is characterized as follows.

The first group includes 1–6 output pins for controlling firing lamps 4. When electrified they can output high level in the order of 12 3 4 5 6 to activate solid relays directly, so that the firing lamps 4 are lit up from lower to upper successfully. The firing speed of the firing lamps can be changed by changing the value of RP1 and C1.

The second group includes 7–10 output pins for controlling the explosion lamps 5. When the firing lamps 4 are lit up, high levels are output in the order of 7 8 9 10 7 7+8 7+8+9 7+ 8+9+10 8+9+10 9+10 10 to light up explosion lamps 5A, 5B, 5C and 5D respectively. The lighting speed of the explosion lamps can be changed by adjusting the value of RP2.

The third group includes 11–13 output pins for controlling flashing lamps 6. After the second group puts off, high levels are output in the order of 11 12 13 11+12 1 1+13 12+13 11+12+13 to light up flashing lamps 6 in high speed. The flashing frequency can be changed by adjusting the value of RP3.

After the third group completes one cycle or several cycles, the IC resets and the above process is repeated in the order of the first group the second group the third group.

Figure 7:
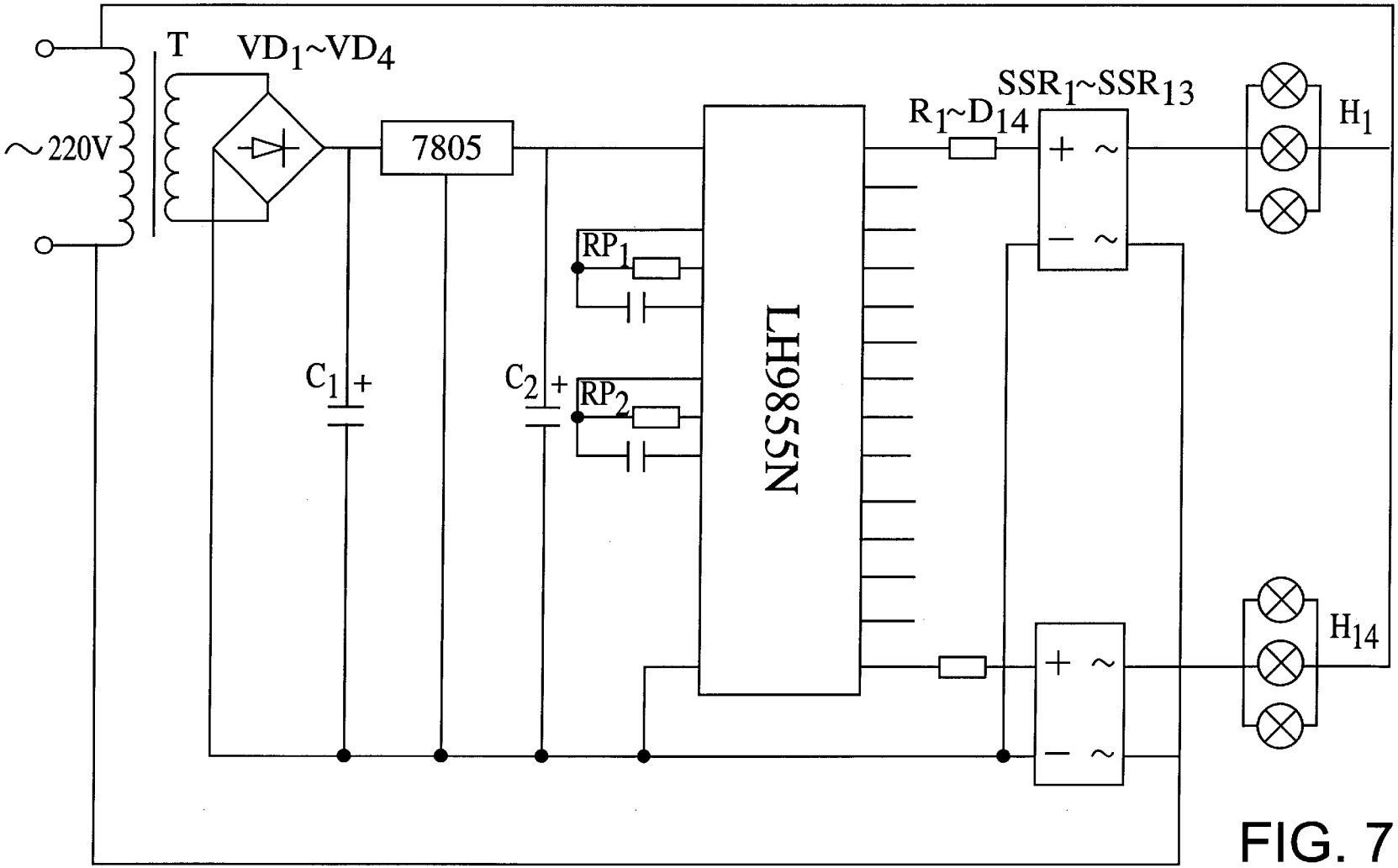
FIG. 7 is a electrical circuit diagram according to the second embodiment of the present invention.

In the second embodiment, the controller is based on integrated circuit (IC) LH9855N which is a plastics-capsulated dual in-line package which is made by using bi-polar and COMS compatible technology. The FIG. 7 shows the arrangement of LH9855N's pins, in which pin 1 is connected with the positive of the power source, pins 2, 3, 4 used for oscillation common ends of explosion lamps are connected with oscillation resistor and oscillation capacitor, pins 5–12 are used for pulse output ends of firing lamps 1–8, pins 14–19 are used for pulse output ends of firing lamps 1–6, pin 13 is connected with the negative of the power source, pins 20, 21 and 21 are common oscillation ends used for firing lamps, pins 23 and 24 are redundant pins.

After electrified, pins 14–19 output high level pulses successively to activate solid relays and light up the firing lamps 4, and after the firing lamps put off, pins 5–12 output high level in the order of 5+6 7+8 9+10 11+12 5+6 5+7+8 5+7+9+10 5+7+9+11+12 7+9+11+12 9+11+12 11+12 12 to control up of the explosion lamps showing in FIG. 4, in which pins 5–12 are respectively corresponding to A–D' showing in FIG. 4 as follows: 5–A, 6–A', 7–B, 8–13', 9–C, 10–C', 11–D, 12–D'.

The control circuit can be configured according to the different forms of explosion of the lamps using the prior arts in order to make the simulation more effective.

What is claimed is:

1. An electronic-controlled simulated fireworks lamp assembly, comprising:

an emitting framework, a supporting ball, connected to the emitting framework, radiating levers, connected to the supporting ball, characterized in that the radiating levers are bent into such a shape as to produce the effect of fireworks exploding; and one or more firing lamps mounted on the emitting framework;

one or more flashing lamps attached to the radiating levers;

one or more explosion lamps attached to the radiating levers; and an electronic-controller for electronically controlling the lighting sequence of the firing lamps the explosion lamps and the flashing lamps.

2. The electronic-controlled fireworks lamp assembly in accordance with claim 1, characterized in that said radiating levers are straight levers.

3. The electronic-controlled simulated fireworks lamp assembly in accordance with claim 1 characterized in that said emitting framework is made of metal tubes.

4. The electronic-controlled simulated fireworks lamp assembly in accordance with claim 1 characterized in that said explosion lamps are arranged to form at least three spherical layers located radially outward from the supporting ball.

5. The electronic-controlled fireworks lamp assembly in accordance with claim 1 characterized in that:

said radiating levers are straight levers;

said emitting framework is made of metal tubes;

said supporting ball is a metal support of spherical shape having a plurality of bores therein;

said explosion lamps are arranged on at least three spherical layers from ball center outward radially; and said radiating levers are connected to the supporting ball by inserting into the bores of the supporting ball directly.

6. The electronic-controlled simulated fireworks lamp assembly in accordance with claim 1, wherein: the firing lamps are comprised of colored tubes which are made of rigid, high strength plastics with light-emitting bodies disposed on the interior of said tubes.

7. The electronic-controlled simulated fireworks lamp assembly in accordance with claim 1, characterized in that the shape of the radiating levers is curved, and the radiating levers are arranged in spherical shape.

8. The electronic-controlled simulated fireworks lamp assembly in accordance with claim 1, characterized in that the firing lamp is made of rigid polycarbonate, the inner surface of which provided with refractive stripes.

9. The electronic-controlled simulated fireworks lamp assembly in accordance with claim 1, characterized in that the radiating levers overlap.

10. The electronic-controlled simulated fireworks lamp assembly in accordance with claim 1, a plurality of supporting balls are arranged on an upper part, a middle part and a lower part of the lamp assembly.

11. The electronic-controlled simulated fireworks lamp assembly in accordance with claim 1, wherein plurality of support balls are mounted upon said emitting framework, with each of said support balls further comprising a plurality of radiating levers.

12. The electronic-controlled simulated fireworks lamp assembly in accordance with claim 1, wherein plurality of support balls are mounted upon said radiating levers.

13. The electronic-controlled simulated fireworks lamp assembly in accordance with claim 1, wherein said radiating levers are straight.

14. The electronic-controlled simulated fireworks lamp assembly in accordance with claim 1, wherein one or more firing lamps are mounted on the emitting framework.

15. The electronic-controlled simulated fireworks lamp assembly in accordance with claim 1, characterized in that said supporting ball is a metal support of spherical shape having a plurality of bores therein.

16. The electronic-controlled simulated fireworks lamp assembly in accordance with claim 1, characterized in that said radiating levers are connected to the supporting ball by inserting one end of said radiating levers into one of the bores of said supporting ball.

17. An electronic-controlled simulated fireworks lamp assembly for simulating fireworks, the assembly comprising:

an emitting framework, one or more flashing lamps connected to the emitting framework;

one or more explosion lamps connected to the emitting framework;

a supporting ball connected to said emitting framework;

a plurality of radiating levers connected to said supporting ball; and an electronic-controller for electronically controlling the lighting sequence of the explosion lamps and the flashing lamps.

18. The assembly of claim 17 wherein the radiating levers are bent into a curved shape.

19. A method of simulating a fireworks display comprising the following steps:

lighting a plurality of firing lamps mounted upon an emitting framework in a second sequence prior to the lighting step of said explosion lamps, wherein said second sequence comprises lighting the firing lamps successively from the lower portion of the emitting framework to the upper portion of the emitting framework;

lighting a plurality of a explosion lamps connected to an emitting framework in a first sequence, wherein said first sequence comprises lighting the explosion lamps denoted as A, B, C in the following order: A and B and C, then A and B, then A and B and C, then B and C, and then C; and flashing a plurality of flashing lamps.

20. The method of claim 19 further comprising the step of turning off all of said firing lamps prior to the lighting step of said explosion lamps.

21. The method of claim 19 further comprising the step of turning off all of said explosion lamps prior to the flashing step of said flashing lamps.

22. The method of claim 19 wherein said second sequence further comprises lighting the explosion lamps denoted as A, B, C, A', B', C' in the following order: A and A', then B and B', then C and C', then A and A', then A and B and B', then A and B and C and C', then B and C and C', then C and C', and then C'.

* * * * *